US006523776B1

(12) United States Patent
Elder

(10) Patent No.: US 6,523,776 B1
(45) **Date of Patent: *Feb. 25, 2003**

(54) WIRE DISPENSING DEVICE

(76) Inventor: Doyle W. Elder, P.O. Box 278, Arapaho, OK (US) 73620

( * ) Notice: Subject to any disclaimer, the term of this patent is extended or adjusted under 35 U.S.C. 154(b) by 0 days.

This patent is subject to a terminal disclaimer.

(21) Appl. No.: 09/766,259

(22) Filed: Jan. 19, 2001

Related U.S. Application Data

(63) Continuation-in-part of application No. 09/660,179, filed on Sep. 12, 2000, now Pat. No. 6,422,504, which is a continuation-in-part of application No. 09/296,419, filed on Apr. 23, 1999, now Pat. No. 6,116,533.

(51) Int. Cl.[7] ..... B65H 16/02; B65H 49/26; B62B 3/02

(52) U.S. Cl. ..... 242/594.4; 242/594.6; 242/557; 242/598.2; 242/598.3; 242/588; 211/85.5; 280/47.35; 280/47.371; 280/79.3; 280/79.6

(58) Field of Search ..... 242/594.4, 594.3, 242/594.5, 594.6, 557, 598.2, 598.3, 588; 280/79.11, 79.3, 79.6, 47.34, 47.371; 211/85.5, 44, 45

(56) References Cited

U.S. PATENT DOCUMENTS

| | | | | | |
|---|---|---|---|---|---|
| 511,639 | A | | 12/1893 | McKinne | |
| 1,581,352 | A | | 4/1926 | Kuen | |
| 2,536,027 | A | | 1/1951 | Braswell | |
| 2,957,644 | A | | 10/1960 | Beardslee | |
| 3,400,828 | A | | 9/1968 | May | |
| 3,759,538 | A | * | 9/1973 | Fabiano | 280/47.35 |
| 3,910,519 | A | | 10/1975 | Martinez | |
| 4,383,398 | A | | 5/1983 | Tipton | |
| 4,457,527 | A | * | 7/1984 | Lowery | 242/594.4 X |
| 4,533,091 | A | | 8/1985 | Knight et al. | |
| 4,564,152 | A | | 1/1986 | Herriage | |
| 4,605,237 | A | | 8/1986 | Torgrimson | |
| 5,188,308 | A | | 2/1993 | Tussing | |
| 5,275,349 | A | | 1/1994 | Tussing | |
| 5,285,981 | A | | 2/1994 | Pavelka | |
| 5,316,232 | A | | 5/1994 | Lambert, Jr. | |
| 5,397,209 | A | | 3/1995 | Heim | |
| 5,509,671 | A | | 4/1996 | Campbell | |
| 6,116,533 | A | * | 9/2000 | Elder | 242/594.4 |
| 6,182,920 | B1 | * | 2/2001 | Watkins | 242/594.4 |
| 6,270,094 | B1 | * | 8/2001 | Campbell | 242/594.4 X |

* cited by examiner

*Primary Examiner*—Kathy Matecki
*Assistant Examiner*—Minh-Chau Pham
(74) *Attorney, Agent, or Firm*—James F. Harvey, III

(57) ABSTRACT

A wheeled dispenser for dispensing wire from spools. The dispenser has a rectangular frame, three stationary vertical posts, and two rotatable vertical posts each located between two stationary posts. Each rotatable post has a plurality of laterally projecting rods for supporting spools. The rotatable post can be rotated to a first position such that the rods are accessible for loading spools, and rotated to a second position wherein each rod can latch to an adjacent stationary post, with the spools held parallel so that they all pay out wire in one direction. The dispenser has wheels and a handle which can incline relative to the frame. A pin arranged to close a clevis secures the handle in a substantially upright position relative to the frame. The frame has upright stanchions bearing receptacles disposed to enable bars to span two stanchions and be held in the receptacles in a horizontal position, so that additional spools can be carried. The frame has holders for storing the bars beneath the frame when they are not mounted on the stanchions.

30 Claims, 5 Drawing Sheets

WIRE DISPENSING DEVICE

CROSS-REFERENCES TO RELATED APPLICATIONS

This application is a Continuation-In-Part patent application and claims priority based upon a prior Continuation-In-Part patent application, entitled "Wire Spool Cart", Ser. No. 09/660,179, filed Sep. 12, 2000, issued as U.S. Pat. No. 6,422,504 on Jul. 23, 2002, which in turn claims priority based upon prior utility patent application, entitled "Wire Dispensing Device", application No. 09/296,419, filed Apr. 23, 1999, which in turn issued as U.S. Pat. No. 6,116,533 dated Sep. 12, 2000.

BACKGROUND OF THE INVENTION

1. Field of the Invention

The present invention relates to a carriage for carrying spools of wire and other elongate stock materials, for the purpose of dispensing the elongate materials. The carriage is employed wherever it is desired to dispense generally similar reeled materials, which may differ in certain aspects, such as dimensions, color, minor internal or external construction, and the like. A preferred application of the invention is in electrical construction, wherein an electrician may require many spools each having different types of electrical wires or cables. However, the invention is equally applicable to dispensing of ribbons, filaments, and other material in industrial, commercial, and other settings.

2. Description of the Prior Art

Construction electricians must typically have at hand many different types of electrical cables for completing a construction project. These types of cables may differ in many aspects. For example, different wire gauges are typically employed throughout a building. In large commercial, institutional, and industrial projects served by multiphase electrical supply systems, the various phases and neutral conductors are usually distinguished by color coding of the insulating jacket. Some applications require stranded conductors, while others require solid, single filament conductors. Therefore, a wide variety of electrical cables area typically required in each construction project.

It is preferred to work with spools of significant length of cable to avoid frequent depletion of a spool. Illustratively, many electricians prefer to work with spools containing 2,500 feet of cable. As wire gauge increases, the various spools become correspondingly heavy. It would be impractical to carry individual spools of wire from place to place within a construction site.

The prior art has proposed carriages adapted to carry spools of wire and to make dispensing easy and practical. An example is seen in U.S. Pat. No. 5,188,308, issued to Norman P. Tussing on Feb. 23, 1993, describes a wire cart adapted to store a plurality of wire spools. The cart has a plurality of vertical posts from which branches project laterally. The spools are supported on the branches. In the device of Tussing, the posts are fixed in position on the cart. By contrast, in the present invention, the posts rotate on the cart between a first position enabling easy loading of a spool onto a branch and a second position wherein wire is paid out in the same direction from which the spools are loaded. The supporting branches or rods of the present invention latch into place in the second position.

U.S. Pat. No. 5,316,232, issued to John A. Lambert, Jr., on May 31, 1994, describes a wire dispensing cart which carries spools of wire. The spools are supported on fixed horizontal rods. By contrast, in the present invention, comparable rods rotate to the first position to enable easy loading of spools onto the rods. The rods in the present invention are then rotated into the second position, from which wire is paid out. The support rods latch into place in the second position.

A wire dispenser seen in U.S. Pat. No. 5,285,981, issued to Steven M. Pavelka on Feb. 15, 1994, supports spools in one position. The device of Pavelka lacks ability to shift between first and second positions and to latch in one of the positions, as seen in the present invention.

U.S. Pat. No. 4,605,237, issued to Donald L. Torgrimson on Aug. 12, 1986, describes a two wheeled wire dispensing carriage wherein spools are supported between the two wheels, which are quite large. The rods supporting the spools are fixed in position generally parallel to the axle. Torgrimson's device lacks the ability to shift between first and second positions, and to latch in one of the positions.

None of the above inventions and patents, taken either singly or in combination, is seen to describe the instant invention as claimed.

SUMMARY OF THE INVENTION

The present invention provides a wire dispensing wheeled carriage which enables spools to be readily loaded onto supporting rods, and orients the spools so that they pay out in one common direction. The carriage has a wheeled frame having a handle, so that it is readily maneuvered through a building under construction. Three fixed or stationary posts project upwardly from the frame. Two spool supporting posts are disposed between each two adjacent fixed posts. The spool supporting posts have laterally projecting rods onto which spools are loaded. The spool supporting posts are rotatably mounted on the frame. The spool supporting posts rotate from the position in which spools are loaded to a second position wherein the rods latch to the fixed posts for stability. The second position is that wherein the posts have been rotated or displaced ninety degrees from the first position. Wire is paid out with the spool supporting posts in the second position.

This arrangement enables each rod to be loaded from the right or left side of the carriage. After the spool supporting posts are rotated and latched into the second position, wire can be paid out to the right or left side from many spools.

The frame has two upright stanchions at the right side and a two upright stanchions at the left side, for holding additional spools. Each stanchion terminates in a receptacle which removably receives a rod. A rod can be loaded with spools and placed so as to span two stanchions. The stanchions are lower in height than the location of the rods projecting from the spool supporting posts, so that all spools carried on the rods can pay out wire in the same direction as those of the spool supporting posts without interfering with the latter. The rods are stored beneath the frame when not in use as auxiliary supports for spools.

Accordingly, it is one object of the invention to provide rotatable posts which are loaded with spools in one position and which rotate to a second position displaced ninety degrees from the first position.

Yet another object of the invention is to provide wheels and handle to the wire dispenser, so that it functions as a cart.

An additional object of the invention is to provide auxiliary spool carrying apparatus on the wire dispenser.

It is a further object of the invention that the auxiliary spool carrying apparatus be readily assembled to and disassembled from the cart.

It is another object of the invention to provide a removable work bench resting on top of the frame upon which a worker may conduct secondary work activities relating to wire dispensing.

It is another object of the invention to provide a fixed horizontal work surface attached to the top of the frame above the rotating posts upon which a worker may conduct secondary work activities.

It is another object of the invention to provide a plurality of attachment points above the rotatable posts so that other work-related items can be attached as needed, such items being work surfaces, bins, drawers, inclined drafting tables, and the like.

A further object of the invention is that the rotating post also be removable so that an existing rotating post may be replaced with another type having a different spool carrying capability.

It is an object of the invention to provide improved elements and arrangements thereof in an apparatus for the purposes described which is inexpensive, dependable and fully effective in accomplishing its intended purposes.

It is one object of the invention to provide rotatable posts which are loaded with spools in one position and which rotate to a second position displaced ninety degrees from the first position and which can be releasably positioned at any angle of rotation therebetween.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
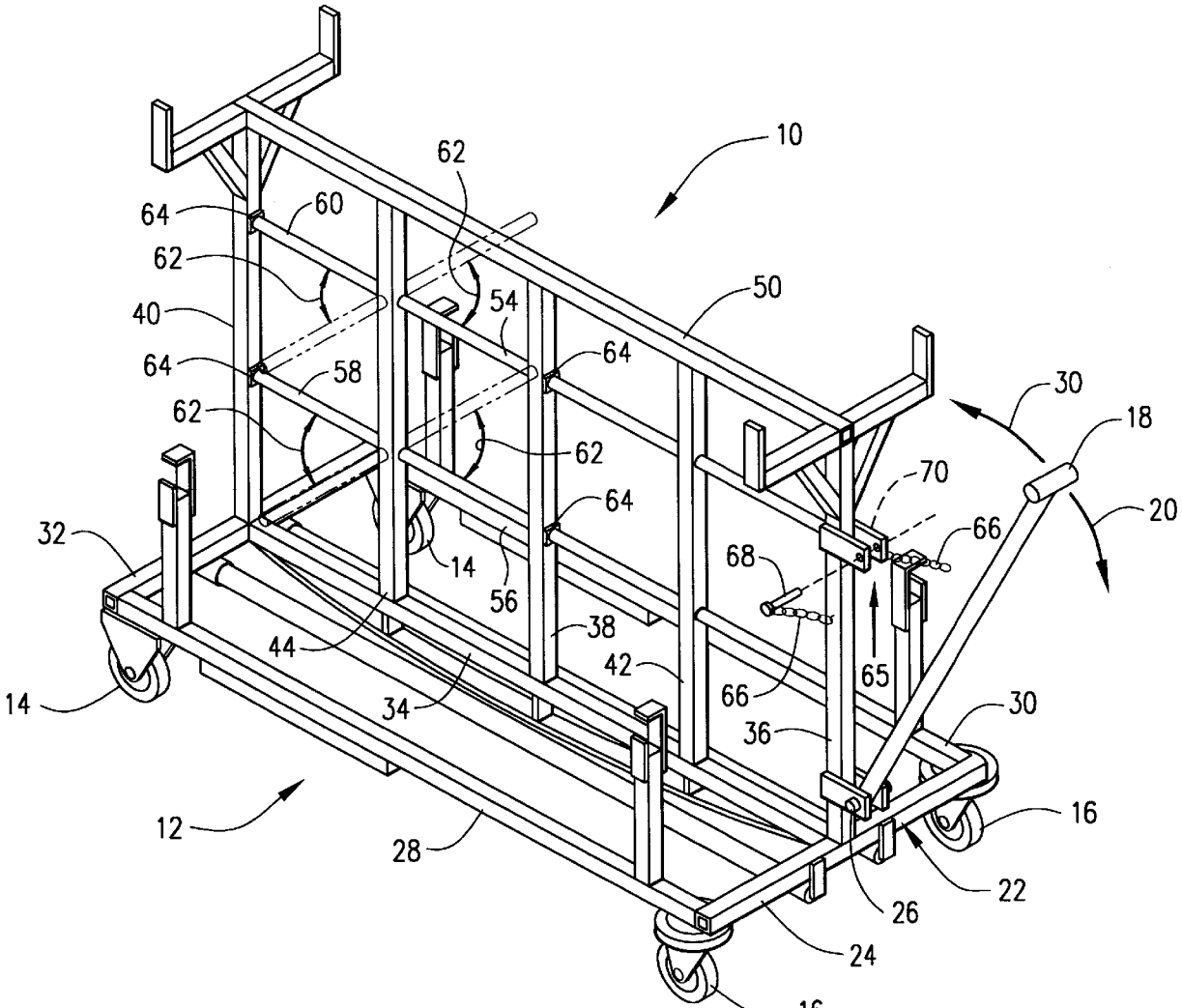
FIG. 1 is a perspective partial view of the invention, with some components omitted and broken away for clarity.

FIG. 1 of the drawings shows a preferred embodiment of the invention wherein dispenser 10 is a wheeled carriage or cart capable of being rolled over and maneuvered along a floor (not shown) or other flat environmental surface. Dispenser 10 dispenses elongate stock material from spools (see FIG. 3). Dispenser 10 comprises a square or rectangular frame 12 bearing fixed wheels 14 and steerably rotatable wheels 16.

A handle 18 is pivotally attached to frame 12 such that handle 18 can be maneuvered by the user to assume different angles relative to a horizontal direction. It will be assumed that dispenser 10 is horizontally oriented in normal use as it is drawn over a floor such that the plane of generally planar frame 12 is parallel to the floor. Attachment of handle 18 may be accomplished employing a suitable pivoting connector enabling inclination of handle 18 as indicated by arrows 20. Illustratively, the base of handle 18 may be entrapped within a clevis 22 fixed to the forward frame member 24, supported on a pin 26 or the like.

Frame 12 comprises five principal structural members, one of which is member 24. Arbitrarily characterizing forward frame member 24 as the front side of the dispenser 10, the remaining structural members are right side channel 28, left side channel 30, rear frame member 32, and central frame member 34. Central frame member 34 is preferably located along the longitudinal axis of frame 12 to assist in maintaining balance of dispenser 10 in both loaded and unloaded conditions. The structural frame members are fabricated from any suitable rigid stock materials, such as square steel tubing.

Three fixed or stationary posts, 36, 38, 40, respectively. A representative way of supporting posts 42, 44 is shown in detail in FIG. 2. Posts 42, 44 have pegs (shown representatively as 46) projecting at either end. Peg 46 is received in a bore 48 extending entirely through frame member 34 at the lower end of post 42 or 44. The arrangement of bore 48 and peg 46 forms a rotatable mounting both enabling its associated axis 52 such that axis 52 is constrained to remain in a fixed position relative to frame 12.

A structural member 50 (see FIG. 1) spans and is secured to posts 36, 38, 40 at the top thereof. Spool supporting posts 42, 44 are rotatably fixed to member 50 in a manner similar to that by which they are mounted on central frame member 34, although the mounting arrangement at member 50 is a mirror image of the mounting arrangement at member 34. It will become apparent that posts 42, 44 can then rotate freely about their vertically oriented longitudinal axes 52.

Returning to FIG. 1, spool supporting post 44 has four rods 54, 56, 58, or 60 is connected to its associated spool support post 44 at one end and has a second free end. Post 42 is similarly configured and functions similarly as post 44, although full illustration of post 42 is broken away for clarity of FIG. 1. Rods 54, 56, 58, 60 are dimensioned and configured to abut adjacent fixed posts 38, 40 in the position indicated by solid lines. Post 44 can be rotated ninety degrees, as indicated by arrows 62, so that rods 54, 56, 58, 60 come to project to the right and left sides of dispenser 10. Spools (shown in the dispensing position in FIG. 3) are loaded onto rods 54, 56, 58, 60 in the position indicated in broken lines in FIG. 1.

Figure 4:
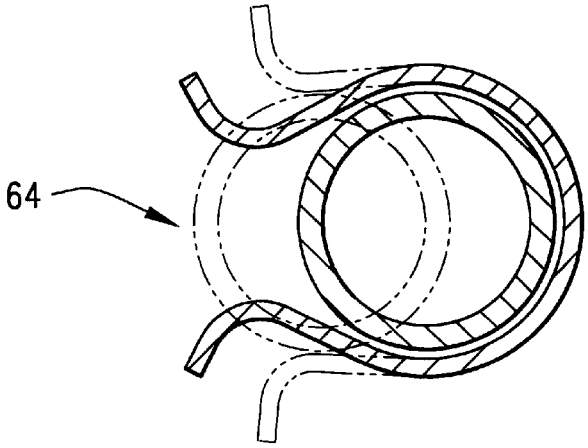
FIG. 4 is a detailed sectional view taken from FIG. 1 and FIG. 3, showing a type of latch for receiving a spooling rod as it intersects the spool support post.

After loading spools, post 44 is rotated until rods 54, 56, 58, 60 come to abut posts 38, 40. Rods 54, 56, 58, 60 are received in latches 64. Each latch 64 is of any suitable well known type. A representative latch 64 is shown in FIG. 4.

Again referring to FIG. 1, handle 18 is retained in a substantially upright position relative to post 36 by a chain 66 and pin 68. The upright position need not necessarily be vertical. It is merely desired that handle 18 not incline forwardly to a degree which would unduly interfere with environmental objects and intrude upon work space. Handle 18 is received in a clevis 65 and retained by a pin 68 which is passed through bores 70 formed in clevis 65.

Figure 3:
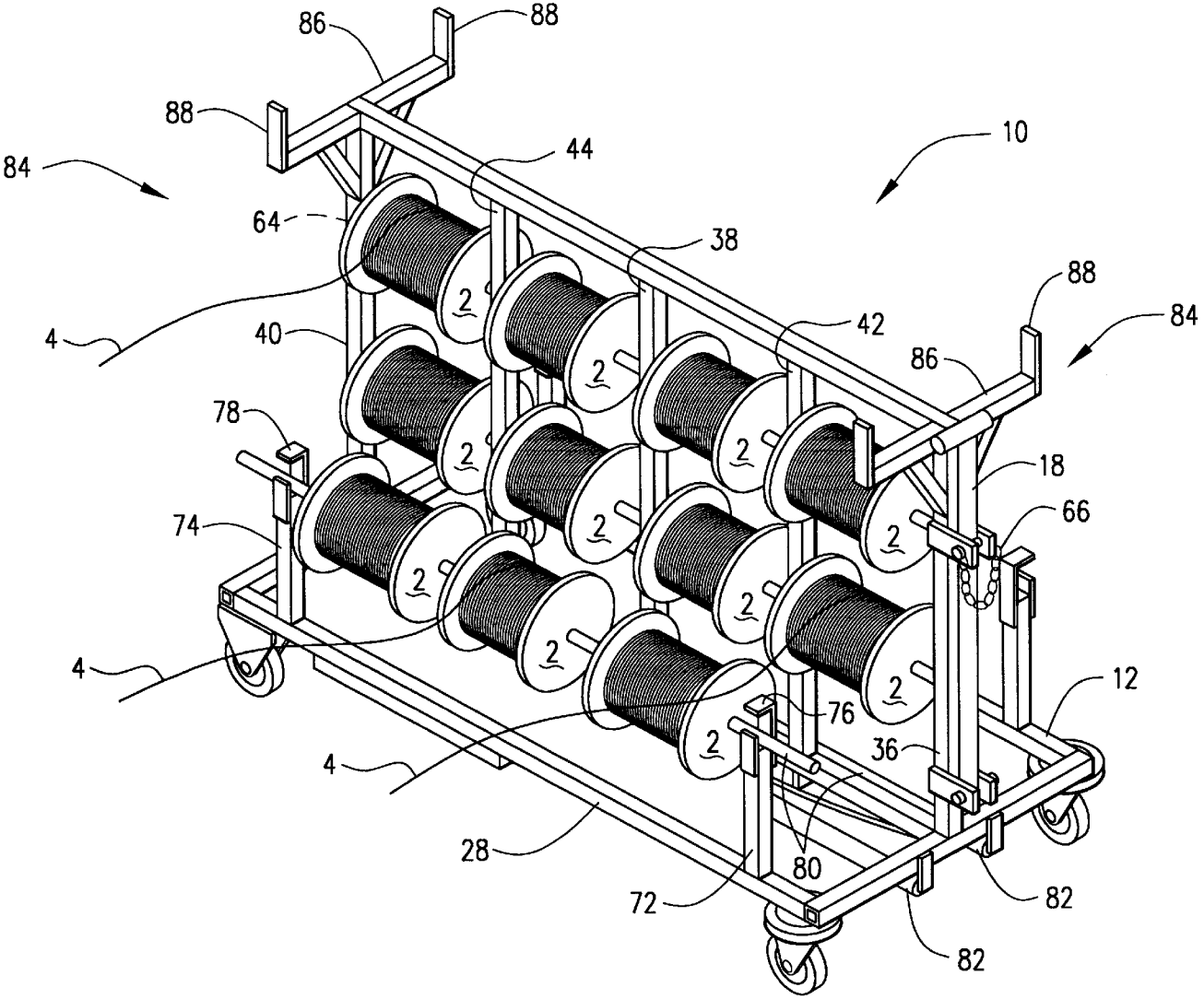
FIG. 3 is an environmental, perspective view of the invention.

FIG. 3 illustrates dispenser 10 in a condition loaded with spools 2. It will be seen that spools 2 may be arranged to pay out wire 4 in one direction, thereby facilitating the task of an electrician who may select among the available types of wire 4 while standing in one place at the right or left side of dispenser 10.

Also shown in FIG. 3 is an optional auxiliary arrangement which increases the number of spools 2 which may be made available for dispensing wire 4. Two low stanchions 72, 74 project upwardly from frame member 28. Each low stanchion 72 or 74 terminates at its upper end at a receptacle 76 or 78 dimensioned and configured to retain a bar 80 which may be manually placed into receptacles 76, 78. Receptacles 76, 78 partially surround or entrap bar 80, which is retained by gravity. Receptacles 76, 78 have an opening enabling manual insertion and withdrawal of bar 80. Bar 80 may be loaded with one or more spools 2 prior to being mounted in its operable location supported on low stanchions 72, 74. Stanchions 72, 74 are low in that when bar 80 is loaded with spools 2 and mounted in its operable location, it will not interfere with access to wires 4 being paid out from spools 2 supported on posts 42, 44.

Bar 80 is stored beneath frame 12 when not received within receptacles 76, 78. This is accomplished by providing holders in the form of sockets or clips 82 attached to and located beneath frame 12. The arrangement of stanchions 72, 74, bar 80, and clips 82 is repeated in mirror image fashion on the left side of dispenser 10 so that additional wire 4 may be paid out from the left side of dispenser 10 if desired.

Dispenser 10 can be employed to carry elongate materials such as lumber and electrical conduit and tubing in addition to carrying spools 2. These additional materials may be carried on frame 12, spanning members 24 and 32 to the right and left of posts 36, 38, 40, 42, 44. Stanchions 72, 74 perform a second function in serving as stops retaining materials on frame 12, preventing such materials from sliding and rolling off frame 12. Still additional elongate objects may be carried on upwardly open carriers 84 which are fixed to the upper ends of posts 36, 40. Illustratively, lumber carried on open carriers 84 could be employed as shelves. Carriers 84 have horizontally oriented lateral members 86 and upwardly projecting stops 88 which prevent carried materials from rolling and sliding off members 86 to the right and left.

The present invention is susceptible to variations and modifications which may be introduced without departing from the inventive concept. Some variations (not shown) will be described. For example, frame 12 may be fabricated from circular, square, rectangular, or L-shaped stock metallic channel, lumber, or other suitable materials. Wheels, 14, 16 may be arranged with or without caster. If desired, all wheels 14, 16 may be rotatably mounted to frame 12, or none may be rotatably mounted. Latches 64 may comprise resilient clips or still other arrangements suitable for releasing retaining rods 54, 56, 58, 60. Similarly, receptacles 76, 78 of stanchions 72, 74 may take other configurations, or be replaced by clips, latches, and other apparatus which can releasably hold bar 80.

In further examples, dispenser 10 need not be configured to be bilaterally symmetrical, although this is a preferred configuration. Similarly, the various fixed and rotatable posts can be arranged to pay out wire in directions other than to the right and left, although this arrangement is deemed most efficient from the standpoint of maximizing the number of spools which are accessible along the length of dispenser 10. Of course, locations of the handle and of fixed and rotatable wheels could be changed so that the resultant dispenser would be wider than it is long, if it were desired to pay out wire to the front and rear sides.

Figure 2:
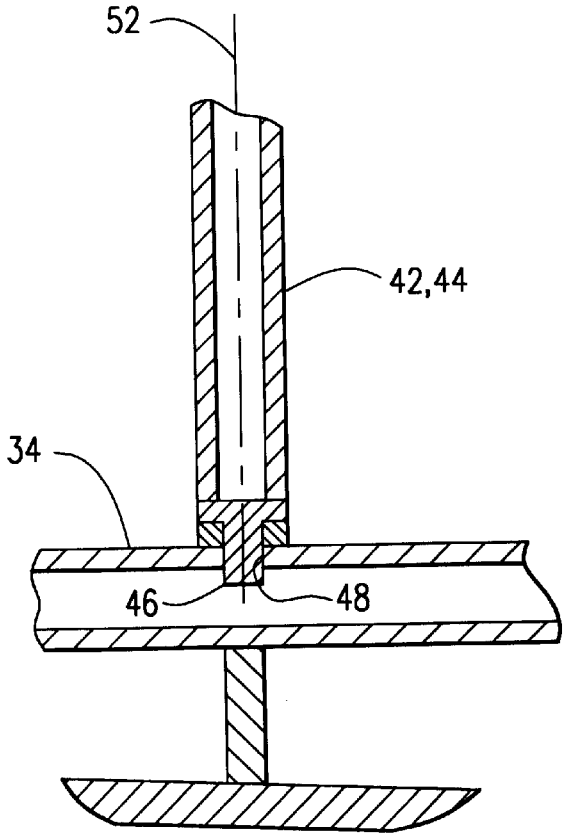
FIG. 2 is a side cross sectional detail of the base of a spool supporting post as it rotatingly connects to the central frame member.

The embodiment of FIGS. 1 and 2 enables rods 54, 56, 58, 60 to be rotatably mounted relative to frame 12 in that they are fixed to a common element (i.e. post 40) which itself is rotatably mounted on frame 12. In a variation of this arrangement, posts 42, 44 could be fixed to frame 12, with rods 54, 56, 58, 60 being rotatably mounted on posts 42, 44 although the arrangement of FIGS. 1 and 2 is preferred for economy of manufacture. Rotatable mountings, where employed, could incorporate bearings and other swiveling mechanisms.

It should be understood that the present embodiment does not limit each post mounted in frame 12 to having the same configuration and arrangement of rods thereon. It can be readily appreciated that frame 12 may be assembled in a manner other than as by welding, so that frame 12 may be disassembled to allow replacement of posts 42 and 44 with similar posts having different arrangements of rods, so that dispenser 10 can be configured to dispense material from different sized rolls. Such reconfiguration of spool supporting posts may be accomplished in a number of ways. For example, structural member 50 may be attached at its ends to posts 36, 38, 40 as by bolts, screws, clamps, pins, or similar means well known to the art to allow structural member 50 to be readily removed for interchanging and replacement of rotatable posts 42, 44. Similarly, posts 36, 38, 40 can be attached at their lower ends to central frame member 34 as by bolts, screws, clamps, pins, or similar means well known to the art to permit access and replacement of rotatable posts 42, 44. In yet another embodiment, pins 46 may be configured so that they may be removably inserted into the central axis of spool supporting posts 42, 44 through bore 48 in either or both the top surface of structural member 50 and the bottom surface of central frame member 34 and secured. When pins 46 are removed, then spool supporting post 42, 44 could be easily removed and replaced by another such post. Other cooperative arrangements of spool supporting posts, frame, and frame members may be envisioned to allow easy and rapid replacement of the spool supporting posts. Permitting replacement of spool supporting posts using standard tools simplifies the manufacturing process and allows dispenser 10 to be custom configured for different requirements.

Another embodiment to the invention described herein involves a means to lock the rotating posts 42, 44 in positions other than the position as described previously. As mentioned previously, after loading spools, posts 42, 44 can be rotated until rods 54, 56, 58, 60 come to abut fixed posts 38, 40, where the rods are received in latches 64, a representation of which is shown in FIG. 4. This locking means releasably locks the rotating posts 42, 44 into a fixed position, which for purposes of reference shall be called the 0° position. However, it should be noted that this does not preclude the use of other obvious locking means used to lock rotating posts 42, 44 at any angle between the 0° position and the 90° position, as shown in FIG. 1. One such arrangement would be to fix a horizontally oriented disk to the lower end of rotating post 42 with pin 46 protruding through the disk to permit the post and disk to rotate as a unit. A series of holes are drilled around the edge of the disk. A hole would be drilled into central frame member 34 and positioned to receive a removable pin vertically and downwardly inserted through one of the holes in the circumference of the disk. Such an arrangement would serve to lock the rotating post in an intermediate position between the 0° position and the 90° position. It has been found in practice that such an arrangement has utility in the situation where the workman wishes to draw wire from the end, rather than the middle, of wire dispenser 10, in such a situation, it is desirable to lock the rotating post 42, 44 in the 90° position for convenience.

Figure 5:
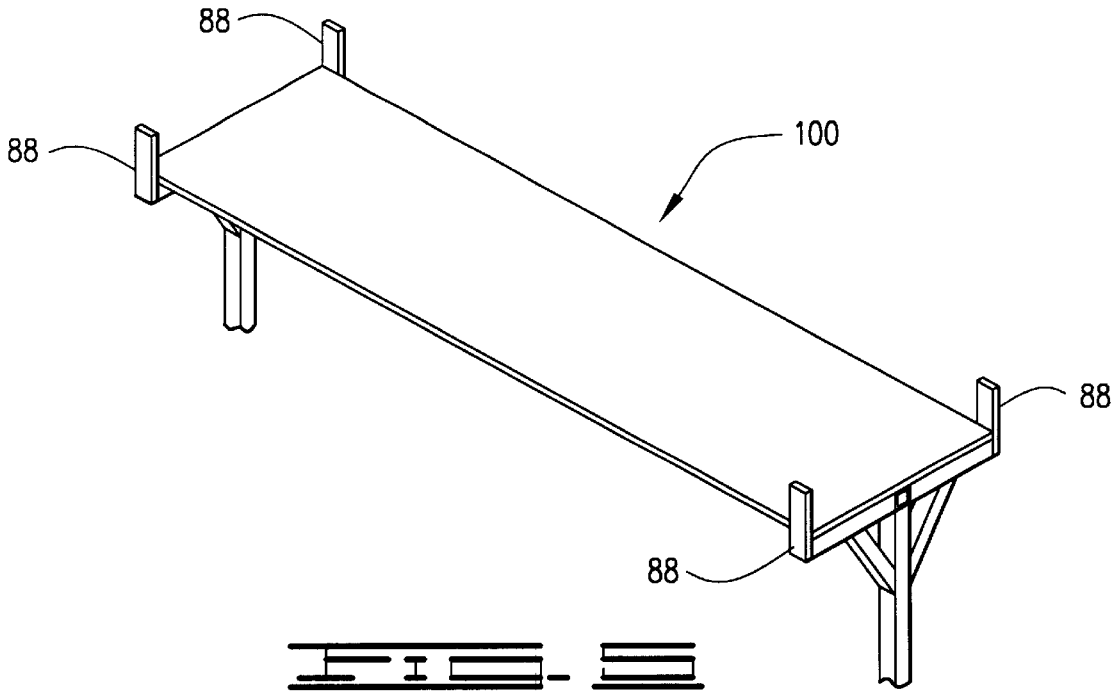
FIG. 5 shows the invention with an optional removable horizontal work surface.
Figure 6:
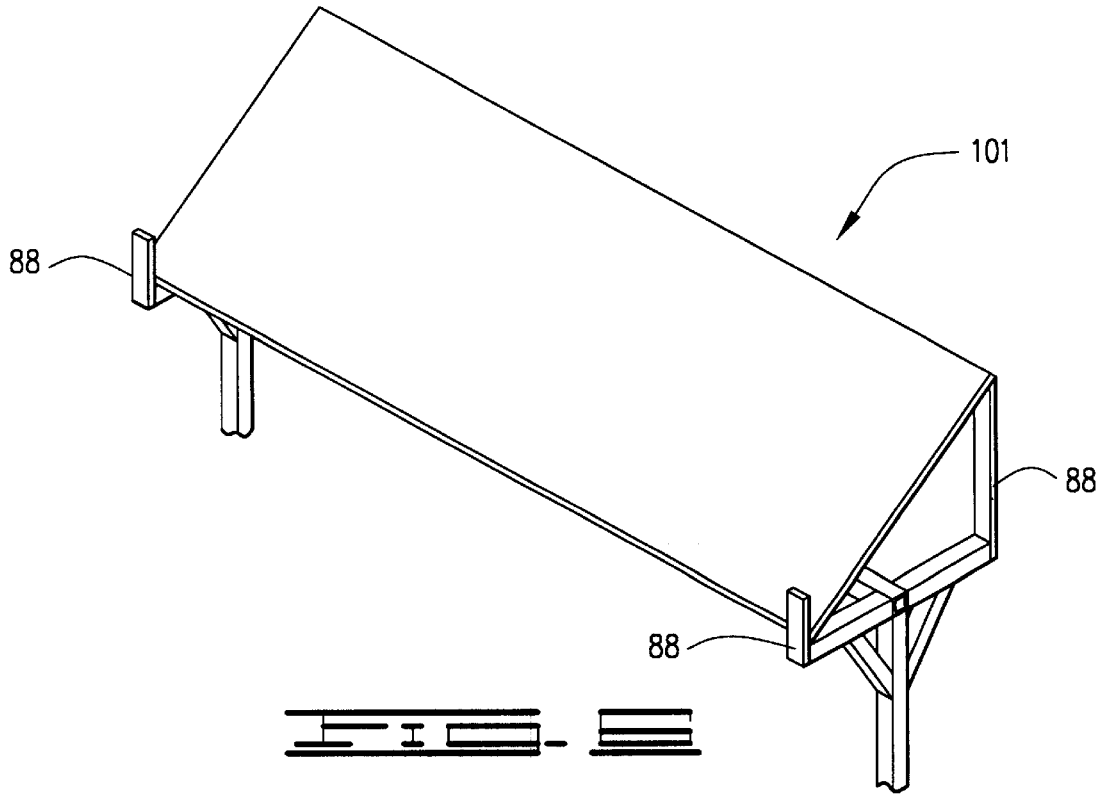
FIG. 6 shows the invention with an optional work surface having a portion inclined downwardly for use with blueprints.
Figure 7:
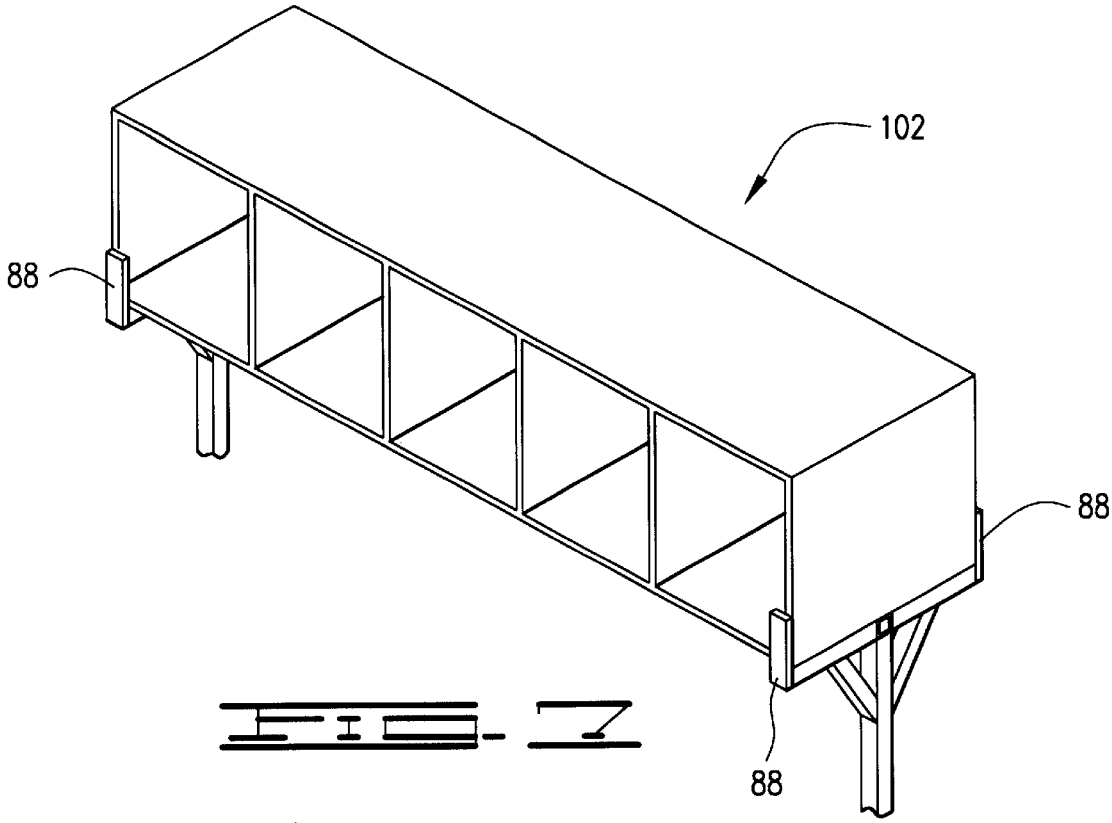
FIG. 7 shows the invention with an optional series of horizontal bins for storing small tools.
Figure 8:
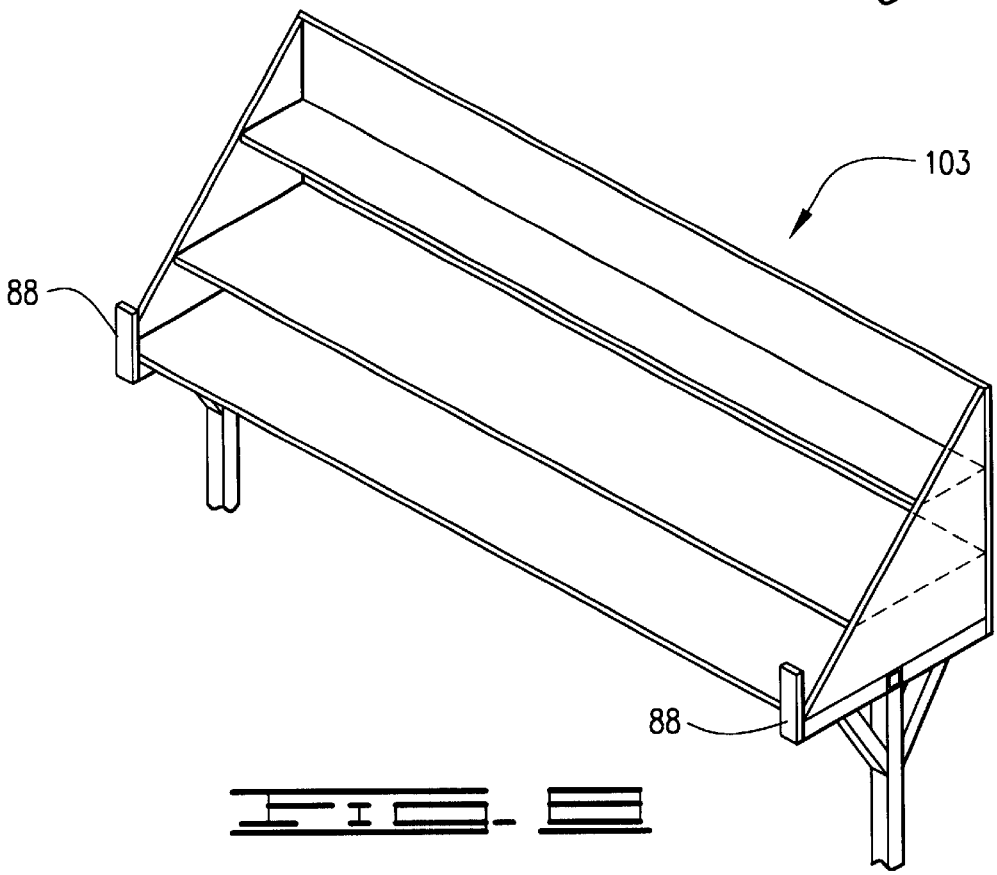
FIG. 8 shows the invention with an optional series of horizontal tool shelves.

As mentioned previously, lumber and other elongate items may be carried on frame 12 by means of upper end carriers 86 with upwardly projecting stops 88 to their ends. This is only one specific embodiment of a general carrying means which may be fixedly or removably connected to the fixed posts of dispenser 10. In a variation of that embodiment, structural member 50 in FIG. 1 may also serve as a support for a horizontal work surface. In its simplest form, such a work surface 100 (FIG. 5) might consist of a piece of plywood, steel, or similar rigid material sized to fit between upwardly projecting stops 88. However, other embodiments of a work surface are possible and contemplated within the concept of the invention. A work surface may be removably or permanently affixed upon upper end carriers 86, structural member 50, or upper posts 36 and 40 as necessary to provide a stable horizontal surface for the placement of tools, materials, parts, water containers, and other items used during the work process. It could be variously configured as the following: a horizontal tool shelf 100 (FIG. 5) for placement of tools and other objects during work; a vertical panel having clips to hold and organize tools in a convenient arrangement; a foldout blueprint table 101 (FIG. 6) with extendable and/or slanting surfaces to permit the spreading and viewing of blueprints for rapid access during the work process; a bank of multiple, horizontally oriented storage bins 102 (FIG. 7) to contain various parts and items for easy accessability during work; or multiple horizontal shelves 103 (FIG. 8) positioned vertically and separated by a distance therebetween. Other obvious variations of these themes would be readily apparent to those skilled in the art.

It is to be understood that the present invention is not limited to the embodiments described above, but encompasses any and all embodiments within the scope of the following claims.

What is claimed is:

1. A dispenser for dispensing elongate stock material from spools, comprising a. a frame;

b. a fixed post solidly fixed to the frame and projecting upwardly from the frame;

c. a spool support post rotatably mounted on the frame and projecting upwardly from the frame, the spool support post having a vertically oriented longitudinal axis and at least one rod projecting laterally from the spool support post such that the rod is connected to the spool support post at one end and has a second free end, the spool support post having a rotatable mounting disposed to rotatably mount the spool support post about its longitudinal axis on the frame and to constrain the longitudinal axis of the spool support post to remain in a fixed position relative to the fixed post and to the frame; and d. the spool support post and the frame cooperatively configured so that the spool support post may be removed from the frame and replaced.

2. The dispenser according to claim 1, wherein said frame has a plurality of wheels depending therefrom, whereby said dispenser can be rolled across a flat environmental surface.

3. The dispenser according to claim 1, wherein said frame has a handle and a pivoting connector disposed to attach said handle pivotally to said frame such that said handle selectively assumes different angles relative to a horizontal direction when said frame is horizontally oriented.

4. The dispenser according to claim 3, further comprising a clevis and a removable pin engageable with the clevis, the clevis and pin disposed to retain the handle in a substantially upright position relative to the fixed post.

5. The dispenser according to claim 1, further comprising holders disposed to releasably hold the at least one rod and the fixed post.

6. The dispenser according to claim 1, further comprising a locking means disposed to releasably and rigidly position said spool support post at a designated angle of rotation.

7. The dispenser according to claim 1, wherein the frame is rectangular and has a front side, a right side, a left side, and a rear side, wherein the fixed post and the spool support post are disposed between the right side and the left side, and wherein the dispenser further comprises at least one low stanchion projecting from the frame, the low stanchion having a receptacle disposed atop the low stanchion, the dispenser further comprising a. a bar dimensioned and configured to be manually removably received in the receptacle, and b. a retainer disposed to retain the bar on the frame when the bar is not received within the receptacle.

8. The dispenser according to claim 1, wherein the dispenser comprises a plurality of fixed posts, each fixed having an upper end, and a carrying means fixed thereto at the upper ends.

9. The dispenser according to claim 8, wherein the carrying means is a horizontal work surface, whereby tools and other work materials may be placed thereon and transported by the carriage along with the spools.

10. The dispenser according to claim 8, wherein the carrying means is a work surface having a portion inclined downwardly from the horizontal, whereby blueprints and other large drawings may be spread out for convenient viewing during work.

11. The dispenser according to claim 8, wherein the carrying means comprises one or more horizontal bins, whereby small items and tools may be stored and used during work.

12. A dispenser for dispensing elongate stock material from spools, comprising a. a rectangular frame having (1) a forward side, a right side, a left side, and a rear side, (2) a plurality of wheels depending therefrom, whereby the dispenser can be rolled across a floor, (3) a first fixed post and a second fixed post, the fixed posts solidly fixed to the frame and projecting upwardly from the frame, each fixed post having an upper end, an upwardly open carrier fixed thereto at the upper ends, and (4) a handle and a swivelling connector disposed to attach the handle pivotally to the frame such that the handle selectively assumes different angles relative to a horizontal direction when the frame is horizontally oriented, and a clevis and a removable pin engageable with the clevis, the clevis and pin disposed to retain the handle in a substantially upright position relative to the fixed posts; and b. a spool support post rotatably mounted on the frame between the fixed posts and projecting upwardly from the frame, wherein the spool support post has a rod projecting laterally therefrom, and means for rotatably mounting the spool support post on the frame, a selected fixed post having a holder disposed to releasably hold the rod to the selected fixed post, wherein (1) the first fixed post, the second fixed post, and the spool support post are disposed between the right side and the left side, and wherein the dispenser further comprises a low stanchion projecting from the frame, the low stanchion having a receptacle disposed atop the low stanchion, (2) the dispenser further comprising a bar dimensioned and configured to be manually removably received in the receptacle, and a retainer disposed to retain the bar on the frame when the bar is not received within the receptacle.

13. A dispenser for dispensing elongate stock material from spools, comprising a. a rectangular frame having (1) a forward side, a right side, a left side, and a rear side, (2) a plurality of wheels depending therefrom, whereby the dispenser can be rolled across a floor, (3) a plurality of fixed posts solidly fixed to the frame and projecting upwardly from the frame, two of the fixed posts each having an upper end, the upper ends supporting a horizontal tool shelf fixed thereto at the upper ends, and (4) a handle and a swivelling connector disposed to attach the handle pivotally to the frame such that the handle selectively assumes different angles relative to a horizontal direction when the frame is horizontally oriented, and a clevis and a removable pin engageable with the clevis, the clevis and pin disposed to retain the handle in a substantially upright position relative to a selected fixed post; and b. a spool support post rotatably mounted on the frame between the plurality of fixed posts and projecting upwardly from the frame, the spool support post having at least one rod projecting laterally therefrom, and a means for rotatably mounting the spool support post on the frame, wherein one of said fixed posts has a holder disposed to releasably hold the rod to one of the fixed posts, wherein (1) each fixed post and the spool support post are disposed between the right side and the left side, the dispenser further comprising a low stanchion projecting from the frame, the low stanchion having a receptacle disposed atop the low stanchion, (2) the dispenser further comprising a bar dimensioned and configured to be manually removably received in the receptacle, and a retainer disposed to retain the bar on the frame when the bar is not received within the receptacle.

14. A dispenser for dispensing elongate stock material from spools, comprising a horizontal frame having a longitudinal axis, a central member located along the longitudinal axis, and a plurality of fixed posts supported on the central member and projecting upwardly therefrom, wherein a. at least one of the posts has a plurality of rods projecting laterally on opposed sides of the at least one of the posts and projecting horizontally therefrom such that each of the rods is connected to the at least one of the posts at one end and has a second free end, the frame has a plurality of wheels depending therefrom, whereby the dispenser can be rolled across a flat environmental surface, and b. at least two of the posts each have an upper end and a carrying means fixed thereto at the upper end;

c. the dispenser further comprising a plurality of low stanchions projecting from the frame, at least one low stanchion having a receptacle disposed atop the at least one low stanchion, the dispenser further comprising a bar dimensioned and configured to be manually removably received in the receptacle, and a retainer disposed to retain the bar on the frame when the bar is not received within the receptacle.

15. The dispenser according to claim 14, wherein said frame has a handle and a pivoting connector disposed to attach said handle pivotally to said frame such that said handle selectively assumes different angles relative to a horizontal direction when said frame is horizontally oriented.

16. The dispenser according to claim 15, further comprising a clevis and a removable pin engageable with said clevis, said clevis and said pin disposed to retain said handle in a substantially upright position relative to said at least one said post.

17. The dispenser according to claim 14, wherein said carrying means is a horizontal work surface, wherein tools and other work materials may be place thereon and transported by said carriage along with said spools.

18. The dispenser according to claim 14, wherein said carrying means is work surface is inclined from the horizontal, whereby blueprints and other large drawings may be spread out for convenient viewing during work.

19. The dispenser according to claim 14, wherein said carrying means consists of a series of horizontal bins for storage of small items and tools to be used during work.

20. A combined wire dispenser and material hauling carriage for carrying spools of wire and other stock materials, comprising a horizontal frame having a longitudinal axis and a central member located along the longitudinal axis of the frame, and a plurality of posts supported on the central member and projecting upwardly therefrom, wherein a. at least one of the posts has a plurality of rods projecting laterally on opposed sides of the at least one of the posts and projecting horizontally therefrom such that each of the rods is connected to the at least one of the posts at one end and has a second free end, b. the frame has a plurality of wheels depending therefrom, whereby the combined wire dispenser and material hauling carriage can be rolled across a flat environmental surface, and c. at least two of the posts each have an upper end and a carrying means fixed thereto at the upper end.

21. The combined wire dispenser and material hauling carriage of claim 20, wherein said carrying means is an upwardly open carrier, whereby lumber, conduit, and other elongate material can be placed in and span said upwardly open carriers.

22. The combined wire dispenser and material hauling carriage of claim 21, wherein a removable work surface is positioned to span said upwardly open carriers.

23. The combined wire dispenser and material hauling carriage of claim 20, wherein said carrying means is a horizontal work surface, wherein tools and other work materials may be place thereon and transported by said carriage along with said spools.

24. The combined wire dispenser and material hauling carriage of claim 20, wherein said carrying means is work surface is inclined from the horizontal, whereby blueprints and other large drawings may be spread out for convenient viewing during work.

25. The combined wire dispenser and material hauling carriage of claim 20, wherein said carrying means consists of a series of horizontal bins for storage of small items and tools to be used during work.

26. The combined wire dispenser and material hauling carriage of claim 20, further comprising a locking means disposed to releasably and rigidly position at a designated angle of rotation at least one said post having said plurality of laterally projecting rods.

27. The combined wire dispenser and material hauling carriage of claim 20, wherein the frame having the central member and the at least one of the posts having a first plurality of rods is cooperatively configured to allow removal of the at least one of the posts from the frame and the central member, whereby the at least one of the posts is replaceable by a second said at least one of the posts having a second plurality of rods.

28. A combined wire dispenser and material hauling carriage for carrying spools of wire and other stock materials, comprising a horizontal frame having a longitudinal axis and a central member located along said longitudinal axis of said frame, and a plurality of posts supported on said central member and projecting upwardly therefrom, wherein a. at least one of the posts has a plurality of rods projecting laterally on opposed sides of the at least one of the posts and projecting horizontally therefrom such that each of the rods is connected to the at least one the posts at one end and has a second free end, the at least one of the posts and the frame being cooperatively assembled to allow the at least one of the posts to be readily removable for replacement;

b. the frame has a plurality of wheels depending therefrom, whereby the combined wire dispenser and material hauling carriage can be rolled across a flat environmental surface; and, c. at least two of the posts each have an upper end and a carrying means fixed thereto at the upper end.

29. The combined wire dispenser and material hauling carriage of claim 28, wherein the at least one of the posts is rotatable, and further comprising a locking means disposed to releasably and rigidly position at a designated angle of rotation at least one of the posts having the removable post.

30. A dispenser for dispensing elongate stock material from spools, comprising a. a frame;

b. at least two fixed posts solidly fixed to said frame and projecting upwardly from said frame, said at least two fixed posts each having an upper end and a carrying means fixed thereto at said upper end; and c. a spool support post rotatably mounted on said frame and projecting upwardly from said frame, wherein said spool support post has a vertically oriented longitudinal axis and at least one rod projecting laterally from said spool support post such that each said rod is connected to one spool support post at one end and has a second free end, and a rotatable mounting disposed to rotatably mount each said spool support post about its longitudinal axis on said-frame and to constrain said longitudinal axis of said spool support post to remain in a fixed position relative to said at least two fixed posts and to said frame.

* * * * *